US006214216B1

(12) United States Patent
Isaacson

(10) Patent No.: US 6,214,216 B1
(45) Date of Patent: Apr. 10, 2001

(54) DRAIN FILTER SUPPORT

(76) Inventor: Ronald Isaacson, 1 Winnipeg Ct., Morganville, NJ (US) 07751

( * ) Notice: Subject to any disclaimer, the term of this patent is extended or adjusted under 35 U.S.C. 154(b) by 0 days.

(21) Appl. No.: 09/411,279

(22) Filed: Oct. 4, 1999

(51) Int. Cl.[7] ..... B01D 29/05; B01D 35/02

(52) U.S. Cl. ..... 210/162; 210/163; 210/164; 210/232; 210/480; 404/4

(58) Field of Search ..... 210/162, 163, 210/164, 232, 474, 479, 480; 404/4, 5

(56) References Cited

U.S. PATENT DOCUMENTS 1,711,674 * 5/1929 Egan ..... 210/163
5,372,714 * 12/1994 Logue, Jr. ..... 210/164
5,397,464 * 3/1995 Hannon ..... 210/163
5,405,539 * 4/1995 Schneider ..... 210/163
5,575,925 * 11/1996 Logue, Jr. ..... 210/164
5,632,888 * 5/1997 Chinn et al. ..... 210/164
5,725,782 * 3/1998 Chinn et al. ..... 404/4
5,954,952 * 9/1999 Strawser, Sr. ..... 210/164
6,045,691 * 4/2000 McDermott ..... 210/164
6,086,758 * 7/2000 Schilling et al. ..... 210/232

OTHER PUBLICATIONS

Petro–Marine Co "Drain Diaper" brochure.*

* cited by examiner

*Primary Examiner*—Christopher Upton
(74) *Attorney, Agent, or Firm*—Robert M. Skolnik

(57) ABSTRACT

A catch basin insert or filter is supported in an open type curb inlet storm drain found on streets and in parking lots. Catch basin filters and inserts are designed to collect coarse sediments, oil, grease and debris from storm water runoff. Such filters normally require support on all four sides of a grate using the weight of the grate. A loop and rod attaches one or more sides of a filter or insert inside a curb inlet storm sewer vault instead of using the weight of the grate.

3 Claims, 3 Drawing Sheets

DRAIN FILTER SUPPORT

BACKGROUND OF THE INVENTION

1. Field of the Invention

The present invention relates to a drain filter support. The support of the present invention modifies the known drain filter sold under the trademark DRAIN DIAPER® so that is can be used with curb and other drains without the need to support the filter about the entire periphery of the drain cover.

2. Description of the Related Art

Sewer drain filters are taught in several prior art patents.

Boosey 2,263,259 discloses a self-cleaning sewer drain where the catch bag 15 is supported around the entire diameter of the pipe 13.

Arntyr, et al., 4,419,232 disclose a collection bag supported by hooks formed on an insert. Round and rectangular versions are shown.

Murfae, et al., 5,133,619, relates to a special construction for a storm drain.

Logue, 5,372,714 and 5,575,925 has carrying loops 34 are formed in the edges of the filter bag and lift rods 40 are inserted into the loops.

Schneider, 5,405,539 discloses the use of pneumatic cylinders 34 and 35 to support a filter structure in storm drain housing. This is best seen in FIG. 2.

Chinn, et al., 5,725,782, FIG. 7, attaches the bag type roll filter to a curb drain with straps 32 or hood 37.

Fanelli, 5,733,445, installs a special covering grate and filter assembly over an existing grate. The filter assembly is supported in the covering grate as shown in FIGS. 4 and 6.

Stetler, 5,744,048 requires a specially configured filter 70 so that the filter can be supported on a support element fabricated as part of a storm drain insert.

SUMMARY OF THE INVENTION

The invention is a modification to the known DRAIN DIAPER® drain filter to enable the filter to be used in drains with the need to support the filter about the entire periphery of the grate. The modification involves the formation of one or more loops on one or more edges of the filter and inserting a spring loaded rod in the loop so that the rod supports the side in the drain housing. In one embodiment of the invention, this support also creates a dam of filter material to prevent debris from entering the mouth of a curb drain.

The present invention supports a catch basin insert or filter in an open type curb inlet storm drain found on streets and in parking lots. Catch basin filters and inserts are designed to collect coarse sediments, oil, grease and debris from storm water runoff. Such filters require support on all four sides of a grate using the weight of the grate. The present invention attaches such a filter or insert inside a curb inlet storm sewer where only three sides of a grate are available for support. The invention may also be used to support the insert or filter within the drain vault without the need to support the insert using the weight of the grate.

The present invention modifies the filter by creating a reinforced pocket on one or more side length of the filter/insert. The pocket(s) accommodates a spring-loaded adjustable heavy-duty rod. The rod is placed inside the pocket and adjusted in length to fit inside the curb inlet drain and/or inside the vault. The rod is then positioned against each sidewall inside the curb drain or vault so that it is secured tightly against the sidewalls. The rod may be adjustable in length and in spring force exerted within the curb drain or the vault. The other sides of the filter without the pockets are supported by the weight of the grate.

The present invention also provides a vertical barrier or dam on the open curbside of the catch basin to prevent debris from falling behind the filter/insert into the basin.

A principal object and advantage of the invention is the provision of a drain filter for catch basins.

Another object and advantage of the invention is the provision of a curb drain filter for curbside catch basins which inhibits debris, etc. from entering the open portion of the catch basin.

A still further object of the invention is the provision of a curb drain filter that modifies an existing filter so that is can be used in curb drains.

Another object and advantage of the invention is the provision of curb drain support which is adjustable so that it can be used in curb drains of different dimensions.

A still further object and advantage of the invention is the provision of a drain filter support which does not require use of the storm drain grate.

Another object and advantage of the invention is the provision of a drain filter support which does not require use of a drain grate to hold the filter.

The foregoing, as well as further objects and advantages of the invention will become apparent to those skilled in the art from a review of the following detailed description of my invention, reference being made to the accompanying drawings.

DETAILED DESCRIPTION OF THE PREFERRED EMBODIMENT

Figure 1:
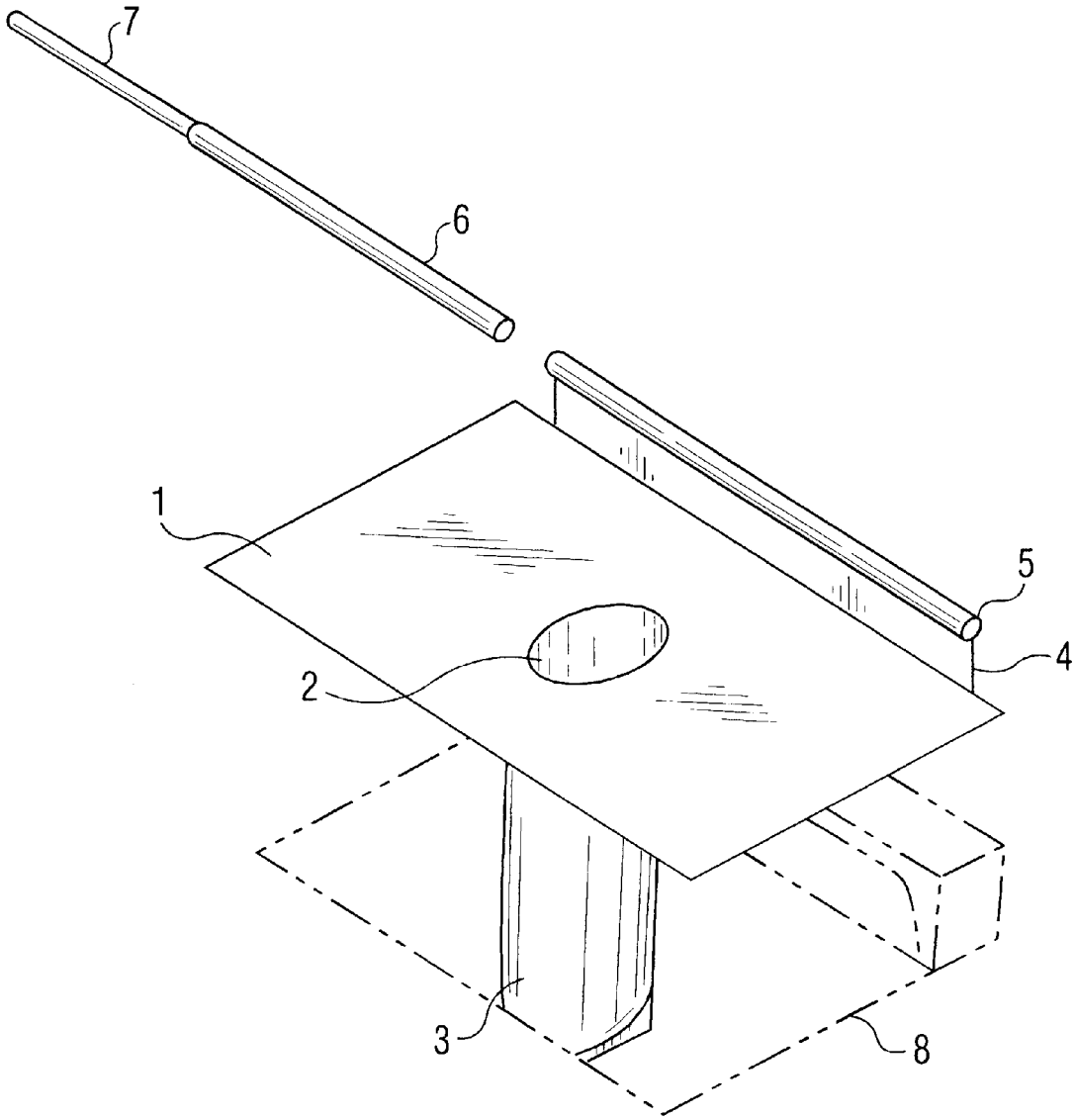
FIG. 1 is an exploded perspective view of my invention.
Figure 2:
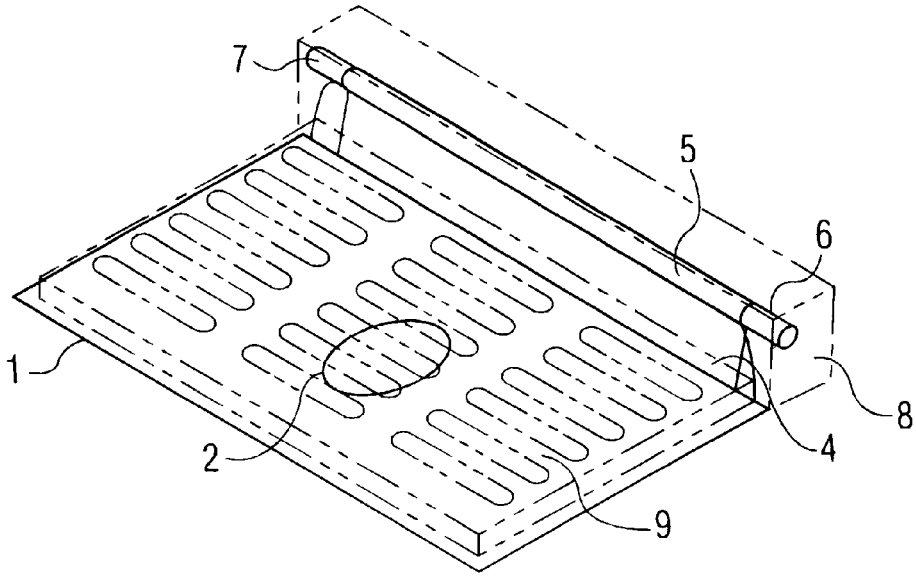
FIG. 2 is a perspective view of the device shown in FIG. 1 in use at a curb drain.
Figure 3:
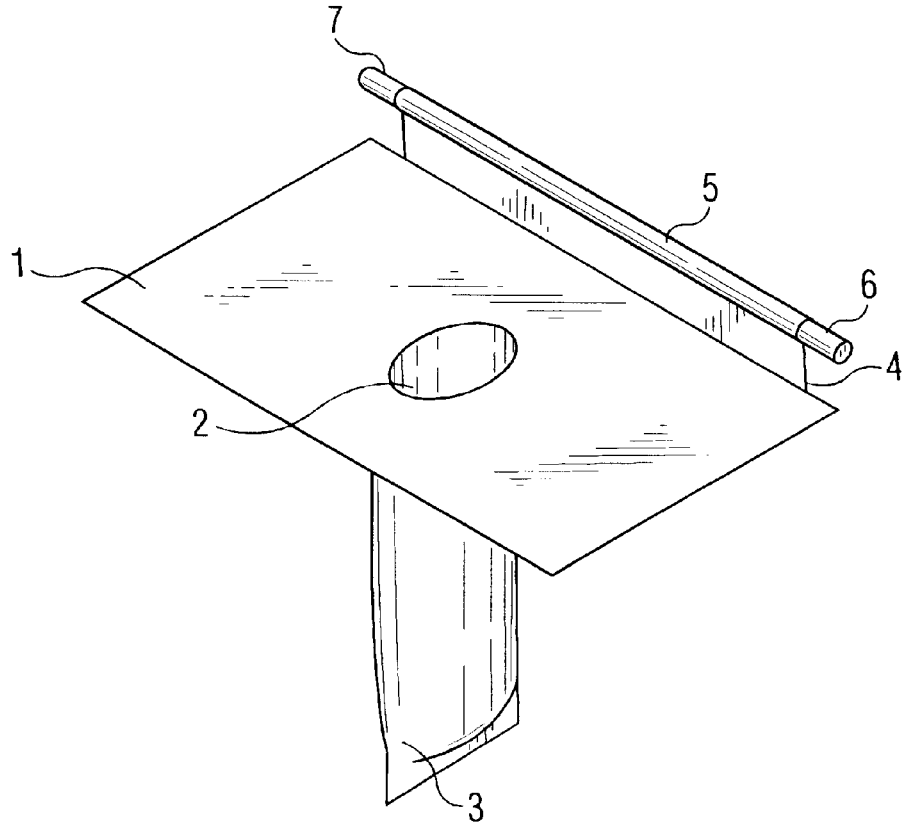
FIG. 3 is an assembly view of the device shown in FIG. 1.

As shown in FIGS. 1–3, where like reference numerals are used to designate like parts, the drain filter has a collection bag 3 attached to a rectangular (or other shape) filter portion 1. A loop 5 is formed on one side of the portion 1 creating a wall 4 of filter material. A rod having two portions 6 and 7 fits within loop 5. The rod may be a spring-loaded rod so that portions 6 and 7 may be adjusted in length.

As shown in FIGS. 1–2, the curb drain 8 has a grate 9 covering same as is well know. An opening between the grate surface and the curb is also known. In use, the grate 9 is removed, filter portion 1 with the bag 3 is placed in the drain, and the grate 9 replaced with the sides of the portion 1 held in placed by the weight of the grate 9. The rod is then inserted into the loop 5 and adjusted to firmly seat within the internal vault structure of the curb drain. Portion 4 is then extended upwards forming a dam to block debris from entering the drain vault though the opening.

As is known in the art, the drain filter shown at numerals 1–3 may be made of materials known in the prior art which are permeable to water, but impermeable to other liquids and solids.

Figure 4:
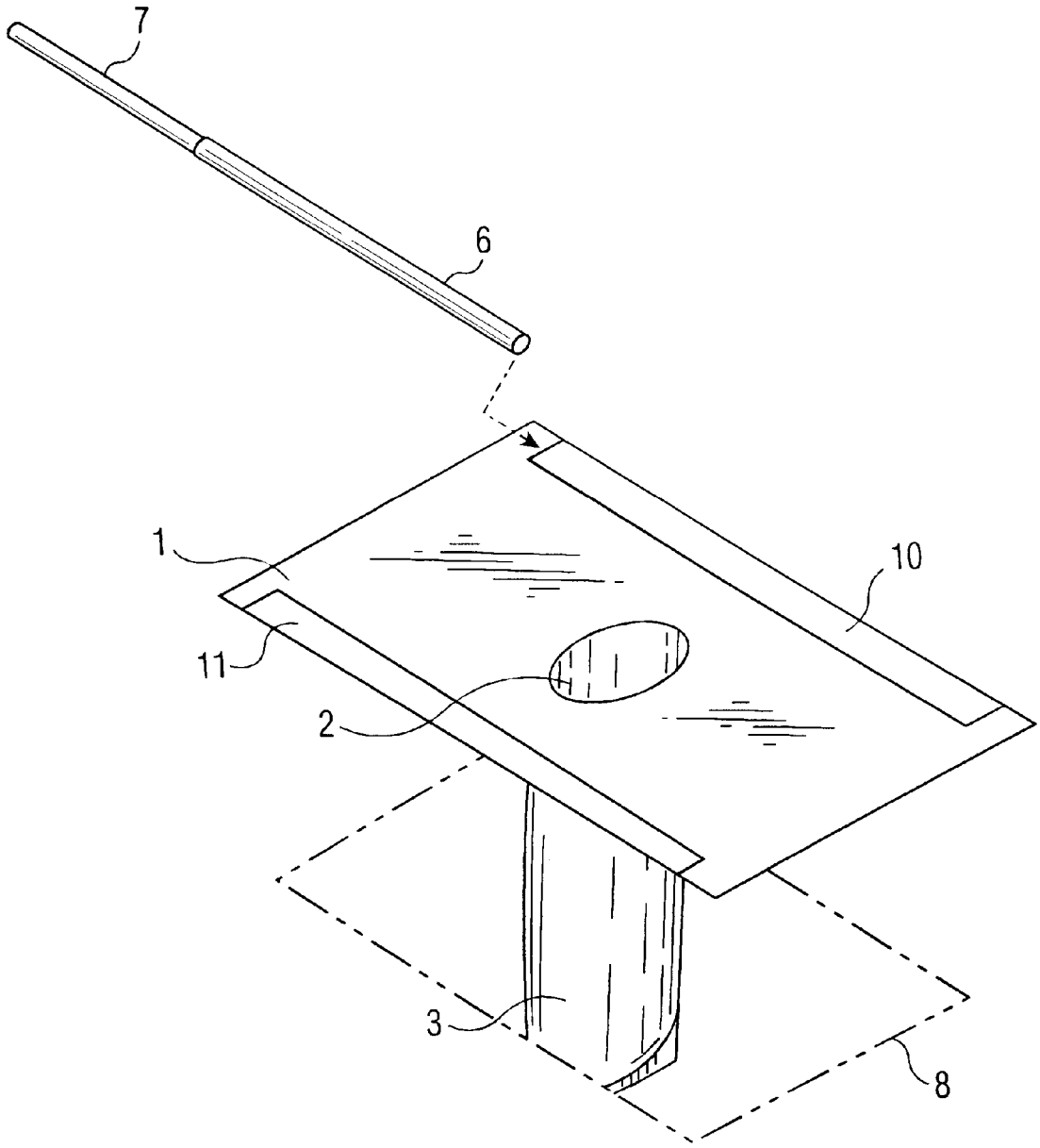
FIG. 4 is a perspective view of a modification to the device shown in FIGS. 1–3.

Other sides of the drain filter may be supported in the vault by formation of loops on the other sides of the drain filter and employing spring loaded rods in those lops to support the filter within the vault against the sidewalls of the vault. As shown in FIG. 4, in which like reference numerals are used to denote like parts from FIGS. 1–3, additional pockets or sleeves such as 10 and 11 are formed on the edges of the filter portion 1. These sleeves or pockets receive spring-loaded rod for supporting that side of the DRAIN DIAPER® beneath the grate against the walls of the storm drain vault. The filter insert is thus independent of support by the weight of the grate. The sleeves or pockets 10 and 11 may be used at one, two, three or all sides of the filter insert.

Further modifications to the apparatus of the invention may be made without departing from the spirit and scope of the invention; accordingly, what is sought to be protected is set forth in the appended claims.

What is claimed is:

1. A drain filter having a collection bag and a rectangular filter surface for supporting said bag by the weight of a drain grate on three sides of said rectangular filter surface; a pocket formed on the fourth side of said rectangular filter support; and, an adjustable length rod mounted in said pocket for mounting said fourth side within a curbside storm drain.

2. The drain filter of claim 1 further including a portion of said rectangular filter surface connected to said pocket for forming a dam preventing debris from entering a storm drain.

3. The drain filter of claim 1 further including means connected to said rectangular filter surface and to said pocket for preventing debris from entering a storm drain.

* * * * *